US010069227B2

(12) United States Patent
Zeng et al.

(10) Patent No.: US 10,069,227 B2
(45) Date of Patent: Sep. 4, 2018

(54) ELECTRICAL CONNECTOR DEVICE

(71) Applicant: XIAMEN ECO LIGHTING CO. LTD., Xiamen (CN)

(72) Inventors: Maojin Zeng, Xiamen (CN); Xiaobo Chen, Xiamen (CN); Tian Zhang, Xiamen (CN); Yongjun Bao, Xiamen (CN); Yongzhe Dong, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 15/508,485

(22) PCT Filed: Jul. 8, 2016

(86) PCT No.: PCT/CN2016/089430

§ 371 (c)(1),
(2) Date: Mar. 2, 2017

(87) PCT Pub. No.: WO2017/088493

PCT Pub. Date: Jun. 1, 2017

(65) Prior Publication Data

US 2017/0271795 A1 Sep. 21, 2017

(30) Foreign Application Priority Data

Nov. 27, 2015 (CN) ..... 2015 1 0843759

(51) Int. Cl.
*H01R 4/02* (2006.01)
*H01R 12/71* (2011.01)
(Continued)

(52) U.S. Cl.
CPC ..... *H01R 12/718* (2013.01); *F21V 19/003* (2013.01); *F21V 23/004* (2013.01);
(Continued)

(58) Field of Classification Search
CPC ... H01R 12/718; H01R 12/7076; F21V 23/06; F21V 23/004; F21V 19/003
See application file for complete search history.

(56) References Cited

U.S. PATENT DOCUMENTS 8,277,240 B2 * 10/2012 Urano ..... H01R 12/57 439/232
9,136,641 B2 * 9/2015 Bishop ..... H01R 4/4836
(Continued)

FOREIGN PATENT DOCUMENTS

CN 204668530 U 9/2015
CN 204704783 U 10/2015
(Continued)

*Primary Examiner* — Xuong Chung Trans
(74) *Attorney, Agent, or Firm* — Chun-Ming Shih

(57) ABSTRACT

An electrical connector device that connects a light source board and a driver board of an LED light electrically. The electrical connector device includes a connector board. The connector board is related to the conductive pins. The connector board is fixed on the light source board and connected to the light source board electrically through the conductive pins. The electrical connector device also includes two electrical connector pieces. Each electrical connector piece includes a whole set for the connection portion and the resistance portion. One end of the connection portion is fixed on the connection board. The resistance portion of the electrical connector piece closes to each other to become an elastic clipping portion and includes the bent and fastening structure. After bending, the fastening structure touches the other end of the connection portion to be fixed on the connection board. The electrical connector device owns the advantages of simple structure and easy to be assembled automatically.

5 Claims, 3 Drawing Sheets

(51) Int. Cl.

| | |
|---|---|
| ***F21V 23/06*** | (2006.01) |
| ***F21V 19/00*** | (2006.01) |
| ***F21V 23/00*** | (2015.01) |
| ***H01R 12/70*** | (2011.01) |
| ***H01R 13/11*** | (2006.01) |

(52) U.S. Cl.
CPC ..... *F21V 23/06* (2013.01); *H01R 12/7076* (2013.01); *H01R 12/7082* (2013.01); *H01R 13/113* (2013.01)

(56) References Cited

U.S. PATENT DOCUMENTS

| | | | | |
|---|---|---|---|---|
| 9,673,544 | B1 * | 6/2017 | Chen | H01R 12/718 |
| 9,768,527 | B2 * | 9/2017 | Bishop | H01R 4/2404 |
| 9,897,264 | B1 * | 2/2018 | Chen | F21K 9/235 |
| 2010/0173540 | A1 * | 7/2010 | Lee | F21V 19/0085 439/861 |
| 2015/0345766 | A1 * | 12/2015 | Wang | F21V 23/00 362/382 |
| 2016/0069555 | A1 * | 3/2016 | Chen | F21V 23/06 439/529 |
| 2017/0276338 | A1 * | 9/2017 | Chen | F21V 23/06 |

FOREIGN PATENT DOCUMENTS

| | | | |
|---|---|---|---|
| CN | 105071081 | A | 11/2015 |
| CN | 205004489 | U | 1/2016 |
| CN | 105351896 | A | 2/2016 |
| CN | 205174291 | U | 4/2016 |
| CN | 205208477 | U | 5/2016 |

* cited by examiner

ELECTRICAL CONNECTOR DEVICE

TECHNICAL FIELD

The present invention is related to a lighting field and more particularly related to an electrical connector device.

BACKGROUND

With the rising of the global environmental awareness, a LED light has developed rapidly in the lightning field. In present LED light tube's socket structure, using artificial welding lead is the common way to connect the electricity from socket to driver board. Connecting two leads through the electricity on driver board to achieve the purpose of the connection in driving two ends of electricity. The connecting way is not conducive for automated production. It needs artificial threading and welding lead. It complexes the production process, lowers the production efficiency, wastes the time and is not good at positioning and installing.

SUMMARY OF INVENTION

In view of this, it is necessary to provide the electrical connector device with a simple structure and an easy combination.

The technical solution for the present invention is an electrical connector device that connects a light source board and a driver board of an LED light electrically. The electrical connector device includes a connector board. The connector board is related to the conductive pins. The connector board is fixed on the light source board and connected to the light source board electrically through the conductive pins. The electrical connector device also includes two electrical connector pieces. Each electrical connector piece includes a whole set for the connection portion and the resistance portion. One end of the connection portion is fixed on the connection board. The resistance portion of the electrical connector piece closes to each other to become an elastic clipping portion and includes the bent and fastening structure. After bending, the fastening structure touches the other end of the connection portion to be fixed on the connection board.

Comparing with the existed technology, the electrical connector device set an electrical connector piece. One end of the electrical connector pieces is related on the connection board through the connection portion. Meanwhile, the other end of connection portion is fixed on the connection board through the bent of the fastening structure. Bending the electrical connector pieces may make the resistance portion close to each other to become an elastic clipping portion. When assembled, just insert the connection board's insert terminal to the elastic clipping portion, and it may realize the electrical connection between the driver board and the light source board. The structure of the electrical connector device is simple. The electrical connector device does not need the artificial welding when assembled. The electrical connector device is easy to set. The electrical connector device owns the advantages of simple structure and easy to be assembled automatically.

DETAILED DESCRIPTION

Though the embodiment to describe the present invention detailed in following statement.

Figure 1:
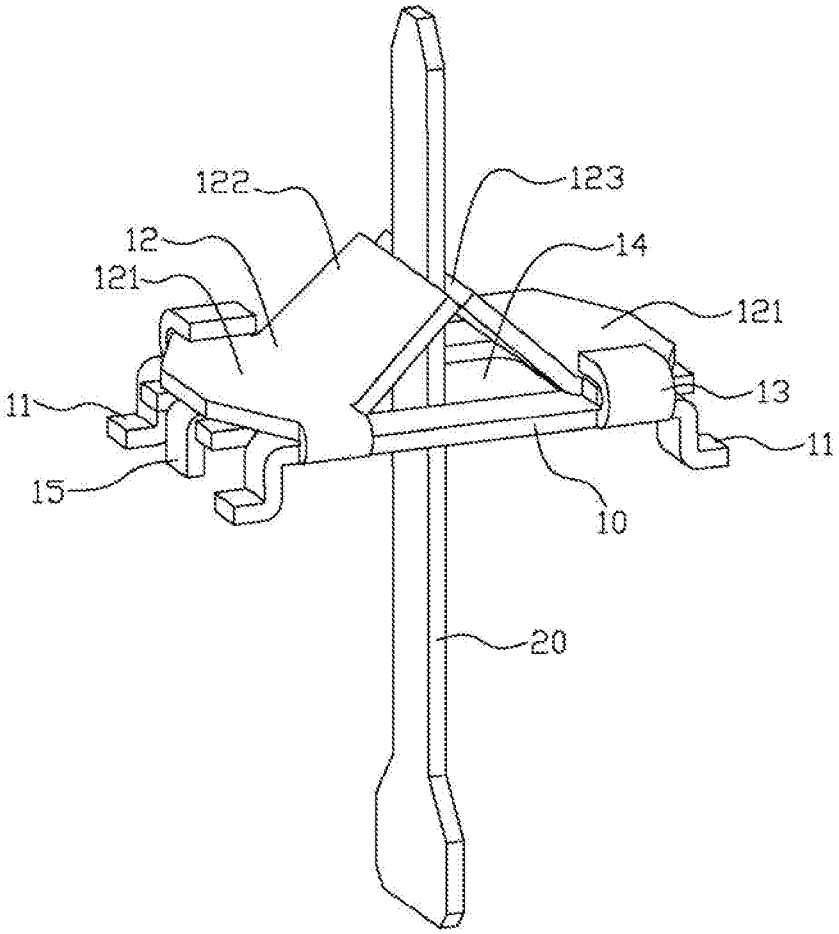
FIG. 1 is the first embodiment stereoscopic drawing for the present invention, an electrical connector device.

FIG. 1 is the first embodiment stereoscopic decomposition drawing for the present invention, an electrical connector device. The electrical connector device that connects a light source board and a driver board of an LED light electrically. The electrical connector device includes a connector board (10). The connector board (10) is related to the conductive pins (11). The connector board is fixed on the light source board and connected to the light source board electrically through the conductive pins (11).

Figure 2:
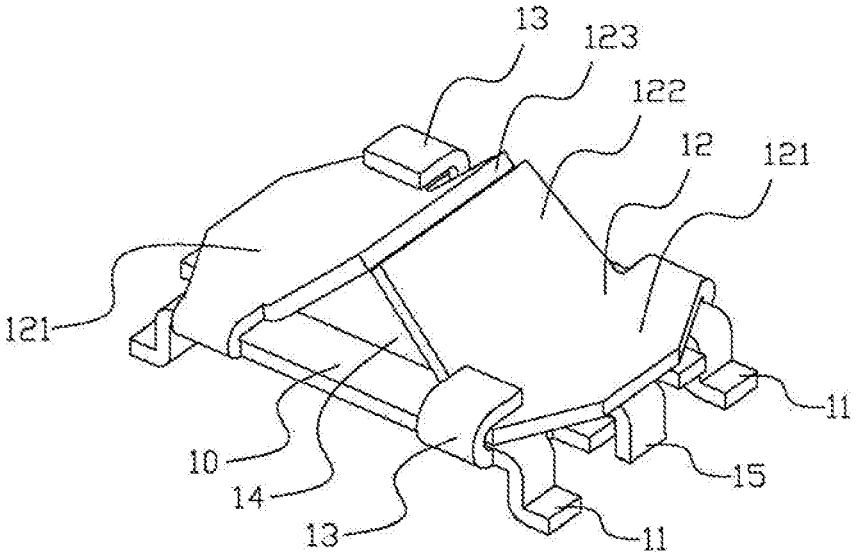
FIG. 2 is the stereoscopic drawing from FIG. 1 that illustrates the electrical connector device.
Figure 3:
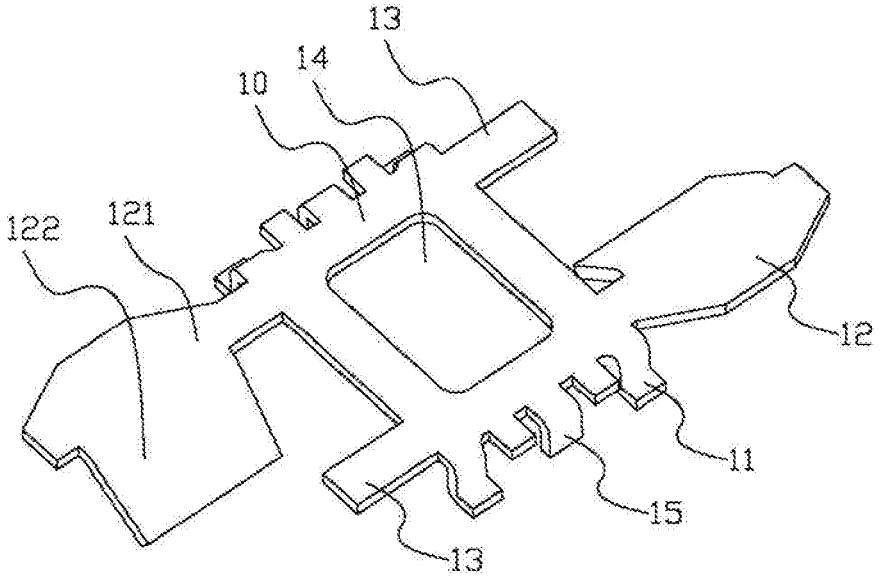
FIG. 3 is the unfolded drawing from FIG. 2 that illustrates the connection board.

Based on FIG. 1 to FIG. 3, there are four conductive pins (11) in this embodiment. The conductive pins (11) are set around the connection board. (10) The conductive pins (11) are bent downside to be "Z" shaped structure from the side of the connection board. (10)

Moreover, the electrical connector device includes two electrical connector pieces (12). Each electrical connector piece (12) includes a whole set for the connection portion (121) and the resistance portion (122). One end of the connection portion (121) is fixed on the connection board (10). The resistance portion (122) of the electrical connector pieces (12) closes to each other to become an elastic clipping portion. (123) In the embodiment, the electrical connector pieces (12) are combined with the connection board. (10) The resistance portion (122) is bent in "/\" shaped structure away from the connection board (10). Among them, the electrical connector pieces (12) is set on the opposite site of the connection board (10) and become a symmetry structure. Bending the electrical connector pieces (12) may close to each other to become an elastic clipping portion. (123) The electrical connector device also includes the bent and fastening structure (13). The fastening structure (13) is related to one end of the connection portion (121) after bending to fix the connection portion (121) on the connection board (10). The connection board (10) and the electrical connector piece (12) are made of metal ingredients. The fastening structure (13) are a whole set with the connection board (10). Moreover, the electrical connector device includes the supporting column. (15) One end of the supporting column (15) is related on the connection board (10). The other end of the supporting column (15) is related on the light source board to increase the ability that the electrical connector device defense the outer power and avoid the top of the electrical connector device be deformed by the outside squeeze.

Among them, the electrical connector device includes an insert terminal (20). One end of the insert terminal (20) is related to the driver board electrically. The middle of the connection board (10) is not own the insert hole (14). The elastic clipping portion (123) is set on the above of the insert hole (14). The other end of the insert terminal (20) is related to the elastic clipping portion (123) electrically after passing through the insert hole. (14)

In conclusion, the electrical connector device set the electrical connector piece (12). One end of the electrical connector pieces (12) is related on the connection board (10) through the connection portion (121). Meanwhile, the other end of connection portion (121) is fixed on the connection board (10) through the bent of the fastening structure (13). Bending the electrical connector pieces (12) may make the resistance portion (122) close to each other to become an elastic clipping portion (123). When assembled, just insert the connection board's insert terminal (20) to the elastic clipping portion, (123) and it may realize the electrical connection between the driver board and the light source board. The structure of the electrical connector device is simple. The electrical connector device does not need the artificial welding when assembled. The electrical connector device is easy to set. The electrical connector device owns the advantages of simple structure and easy to be assembled automatically. Moreover, the electrical connector pieces (12) may be more firm because one end of the electrical connector pieces (12) pass through the connection portion (121) and be related on the connection board; (10) meanwhile, passing through the bent of the fastening structure (13) to make the other end of the connection portion (121) be related on the connection board. (10) Even if the insert terminal insert to the electrical connector pieces (12) will push some pressure, the electrical connector device still not easily to be deformed and loss the function due to the two fixed ends of the electrical connector pieces. (12)

The statement above just for the better embodiment, not for limiting the present invention. All the modification, equal to any change and improvement that are based on the present invention's spirit and principle, may be protected in the present invention protection range.

The invention claimed is:

1. An electrical connector device for connecting a light source board and a driver board of an LED light electrically the electrical connector device comprising:

conductive pins formed by bending sides of a connection board, the conductive pins being fixed to the light source board;

two connector pieces, each connector piece having a connection portion and a resistance portion, the connection portion being extended from resistance portions bent from the connection board, the connection portions of the two connector pieces forming an elastic clipping portion for clipping and electrically connecting to an insert terminal of the driver board passing through an insertion hole of the light source board; and two bent and fastening structures formed by bending the connection board for pressing the resistance portions of the two connector pieces, wherein the two bent and fastening structures and the two resistance portions of the two connector pieces are bent from the same side of the connection board.

2. The electrical connector device of claim 1, wherein the resistance portions of the two connector pieces are bent as a symmetric structure climbing up from two bent sides.

3. The electrical connector device of claim 2, wherein the connection board is made of metal material.

4. The electrical connector device of claim 1, wherein the two connector pieces form a symmetry structure.

5. The electrical connector device of claim 1, wherein there are four of the conductive pins by bending the connector board downside to be "Z" shaped structures.

* * * * *